United States Patent [19]

Cohen

[11] 4,146,934

[45] Apr. 3, 1979

[54] CURVED FINISHING BAND FOR GARMENTS

[76] Inventor: Leslie Cohen, 7 E. 14th St., New York, N.Y. 10003

[21] Appl. No.: 837,677

[22] Filed: Sep. 29, 1977

[51] Int. Cl.[2] ..... A41B 1/12; A41F 9/00

[52] U.S. Cl. ..... 2/127; 2/220; 2/236; 2/274; 36/78

[58] Field of Search ..... 2/236, 220, 237, 221, 2/76, 127, 274, DIG. 11, 243 R; 112/132; 36/78

[56] References Cited

U.S. PATENT DOCUMENTS

| | | | |
|---|---|---|---|
| 1,776,975 | 9/1930 | Levy | 2/127 |
| 2,106,334 | 1/1938 | Adamson | 2/237 |
| 2,708,274 | 5/1955 | Vander et al. | 2/237 |
| 3,162,962 | 12/1964 | Simons et al. | 2/274 X |
| 3,414,907 | 12/1968 | Flame | 2/236 X |

*Primary Examiner*—H. Hampton Hunter
*Attorney, Agent, or Firm*—S. Stephen Baker

[57] ABSTRACT

A fabric, annular band, used for trimming or finishing the terminal edges of a garment, which garment usually has raw outer edges. In many cases, such as waistbands on trousers or skirts, the waistband must be curved, or contoured to adequately complement the anatomical configuration of any wearer. Thus, in any normal person, the hip bones are not on the same level as the waist itself. Accordingly, a simple straight band will not be satisfactory. The art has met the problem by forming the band in multiple sections, interconnected by seams, each section assuming an angularity relative to an adjacent section, to form a composite curved structure. My band, on the contrary, is one-piece, effecting many economies, including eliminating the use of relatively skilled labor.

8 Claims, 4 Drawing Figures

CURVED FINISHING BAND FOR GARMENTS

BACKGROUND OF THE INVENTION (1) Field of the Invention

The field of the invention is garment, outer finishing bands, where the outer edge of the garment must comply with anatomical deviations from a purely, practically non-existent annular shape. The band is essentially circular, or annular, but it is curved or contoured in accordance with anatomical curvatures which are generally in a vertical plane. For example, such a band is invariably arcuate along its length so that a back central portion thereof is at a lower vertical level than the end or front portions thereof. In a waistband for trousers or the like, the back central portion of the waistband will rest against the small of the back, while the end, closure portions will rest over the higher hip portions. This requires a curved waistband.

(2) Description of the prior art

A great number of garments, particularly trouser waistbands (except for the very cheapest types), sew a curved finishing band to the upper raw edges of the garment. The length of the band is normally 1" to 2½" less than the outer edge of the garment to which the band is to be applied. Thereby, a neat horizontal band encircles the general waist portion.

Nevertheless, the length of the band must not be in a simple plane. It must be curved to comply with anatomical requirements as above stated. The prior art has met this problem by providing separate, succeeding lengths, specially shaped, sewn and seamed to each other at varying angular directions, producing a curved band. In waistbands, the seams are often concealed by loops designed to receive ordinary belts.

These requirements demanded skilled and extra labor and materials as will be evident. It is to this problem that my invention is directed.

SUMMARY OF THE INVENTION

Accordingly, it is an object of this invention to provide a one-piece band which meets the above requirements, yet in the simplest and most economical fashion. My band is constructed to be inherently arcuate or curved when assembled and properly folded. I accomplish this by first providing an outer fabric approximately double the width of desired band. The fabric must be bias-cut, i.e. stretchable in diagonal directions, as opposed to very limited vertical or horizontal stretch such as is limited to the characteristics of the thread itself. In this invention, I am principally referring to woven fabrics, since the stretchability of knitted fabrics is hardly controllable, particularly in circumstances where my band is applicable, although certain aspects of the invention may be applicable to knitted fabrics. Knitted fabrics can be cut straight, not biased.

First, as above stated, the overall length of the finishing band will be less than the edge of the garment to which it is applied. Then, I apply a center, non-bias cut tape at the inside center of the doubled, open fabric. The tape itself is 1 to 3 inches less in length than that of the outer fabric. The length of the tape is important and will further determine the ultimate curvature of the finished band.

Since the non-stretchable tape of less length is sewn approximately to the inside center of the double width outer fabric, it will cause the fabric to buckle along its length. This buckle is an intermediate condition and is of no use in the finished belt.

However, when one-half of the outstretched outer fabric is folded over upon itself to form the substantially finished band, the buckles will disappear and become transformed into a curved band. In thus folding the outstretched, outer fabric, the buckles essentially force the band to become arcuate or curved, particularly as the folded outer fabric is pressed into a neat, attractive, smooth, double-layered band, with the finished surface of the fabric outward.

The thus completed band is sewn to the underlying garment by conventional means. It is one-piece, yet properly curved or contoured depending on the choice of the extent of shorter length of the non-bias, non-stretchable center tape, relative to the length of fabric to which it is sewn.

The above principle is not limited to waistbands. It can well be applied to curved neckbands on blouses, and around armholes etc., where anatomical configurations are of aesthetic or even functional significance.

When used as a waistband for trousers or the like, it is preferable to interpose a thin, bias-cut heat-fusible lining between the inner face of the fabric and the tape. This lining is of a size approximately that of the fabric. The lining gives more body to a fabric intended for such heavier duty than would be required with softer fabrics, such as would be used with shirts, dresses, or blouses. Indeed, a fusible, re-inforcing lining might be undesirable with delicate fabrics. When, however, a lining is used, its bias is approximately that of the fabric it reinforces.

BRIEF DESCRIPTION OF THE DRAWINGS

Referring to the drawings.

DETAILED DESCRIPTION

Figure 1:
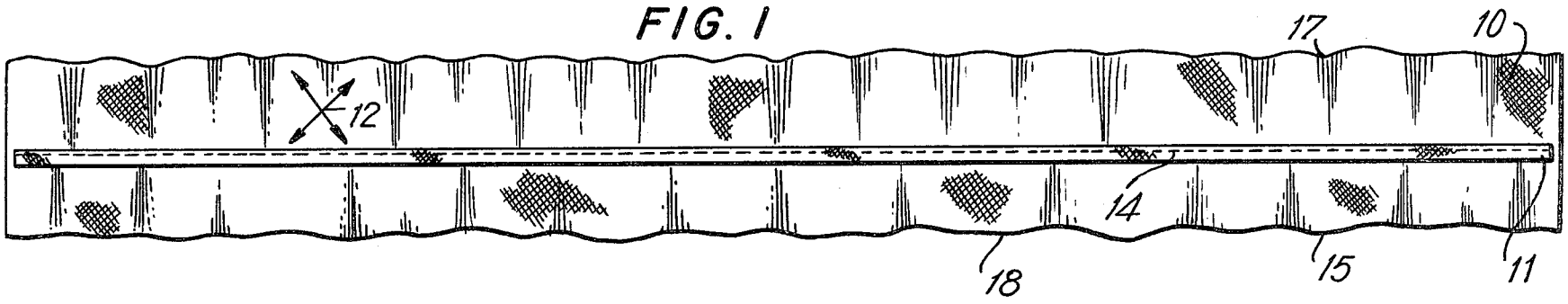
FIG. 1 is a plan view of the doubled width, outstretched fabric of the band, before being folded upon itself at the center tape, the inside surface of the fabric being shown.

Referring first to FIG. 1, the starting, elongated fabric 10 is of any conventional outer fabric for any type of garment. For example, it may be polyester, or any combinations thereof, or cotton, or the like, and is preferably woven. In the form shown, it is suitable as a waistband for trousers, but in principle the invention is applicable to any curved, finishing bands, as hereinbefore stated.

In the form shown in FIG. 1, the length of fabric 10, from end to end, may be about 36", strictly as an example, before the center tape 11 is sewn or otherwise adhered thereto. Fabric 10 is cut on the bias as shown by arrows 12 so that the fabric is stretchable in diagonal directions. This factor, by itself, is conventional as far as I know. In FIG. 1, the width of fabric 10 may be about 4", so that when the fabric is folded over on itself to form opposed outer sides, the width of the finished band will be about 2". These figures are purely representative and are given as an example. Before the tape 11 is sewn thereto, the longitudinal edges of the fabric 10 will be more or less straight, instead of wavy as illustrated.

Tape 11 is often referred to as a "stay-tape." It may be woven fabric, or of flat plastic sheeting, this aspect being immaterial. In the form shown, it was about ⅜" in width or roughly about one-eighth of the width of fabric 10 although these relative dimensions are hardly of significance except to indicate their approximate relative widths. The length thereof is important relative to that of fabric 10.

Tape 11 is non-bias cut. Therefore, it is non-stretchable in any direction, except as its material itself may permit limited stretch. However, as sewn to fabric 10, it is not stretchable. Tape 11 is of a length approximately 1–3 inches or so less than the normal length of fabric 10. However, it is sewn, as by a single line of stitching 14, substantially from end to end of fabric 10, along the inner face of the fabric. Obviously, therefor, fabric 10 will become the length of tape 11, and tuckers or buckled material 15 will result in fabric 10.

It will be evident that the piece of fabric 10, which is normally longer than tape 11, must be tuckered, or puckered, as the tape 11 is sewn thereto in order that the respective ends of the piece of fabric 10, and those of flat tape 11, become substantially coincident. Any competent seamstress, as is commonly understood, knows how to manually tucker the fabric as the shorter tape is sewn thereto, end to end. Alternatively, it is common knowledge that even the relatively unskilled can perform the same operation on an ordinary sewing machine by manually holding the tape very taut, while the machine, with the fabric loose, sews the tape to the piece of fabric and automatically produces tuckers in the fabric. Basically, when a shorter, non-stretchable tape is sewn to a longer fabric, end to end, tuckers in the fabric must result.

It should be noted that the degree of shortening of the length of tape 11, relative to the normal length of fabric 10, will determine the extent of buckling, or production of tuckers, for the purpose of determining the ultimate curvature or contour of the finished band as will be hereinafter set forth. In other words, the greater the relative shortening of the length of tape 11, the greater will be the eventual curvature of the finished band.

Figure 2:
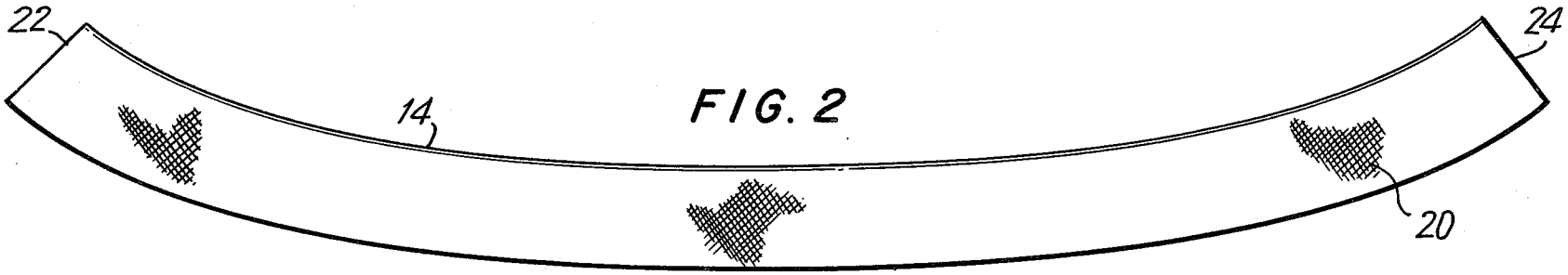
FIG. 2 is a plan view of the finished one-piece band produced from the fabric of FIG. 1, after it is folded upon itself in the direction of the fold.

When the outstretched fabric 10 is provided with tape 11 as shown in FIG. 1, it is thereafter folded or doubled upon itself so that upper edge 17, approximately meets lower edge 18, enveloping or embracing tape 11 in the process, the adjacent edges 17 and 18 being then separated. It may then be pressed flat in its doubled width condition as shown in FIG. 2. Although the folding of fabric 10 is a very simple operation, some care may be taken to assure that the sides of the fabric are pressed against each other smoothly and with no wrinkles. It will be found then that the tuckers or buckles 15 will disappear, and the band 20 becomes smooth, curved or contoured, and indeed is a finished band except for the opposite ends 22 and 24 each of which can be finished off by sewing in any conventional fashion. Usually, these ends are slightly folded inwardly and sewn to produce finished ends. In FIG. 2, the normal outer surface of the fabric is shown, since this side of the fabric will be visible in the finished garment.

After the fabric 10 has been folded over, or doubled upon itself, it is thereafter curved as illustrated in FIG. 2, in the direction of the fold. This will obviously serve to at least minimize, and indeed actually serve to smooth out, the tuckers or buckles so that they will disappear. The obvious reason therefor is that the tuckers fan out as the folded fabric is curved in the direction of the fold.

Figure 3:
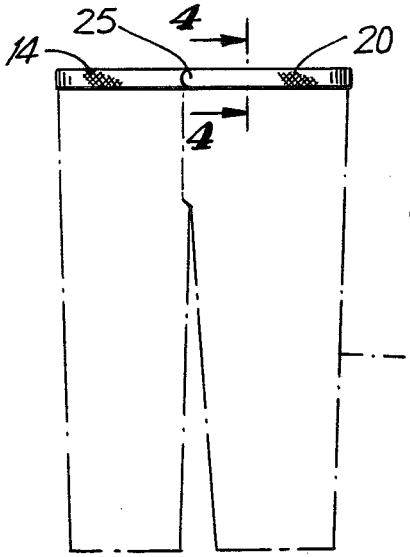
FIG. 3 is an elevational view of a finished one-piece band, produced according to this invention, and secured, for example, to the top end of trousers, as a waistband therefor.

FIG. 3 shows the finished band 20 sewn to the outer, raw edges of a garment, such sewing itself being conventional, the band 20 being then annular when its ends 22 and 24 are interconnected and fastened in any manner at the point 25, such as by an ordinary belt buckle when garment 27 is a pair of trousers, and band 20 is its waistband.

It is further conventional to employ a band 20, which is shorter than the adjoining edges of the garment to which the band is applied. In other words, if the upper, raw edges of garment 27, if considered as stretched out longitudinally, the band 20 being likewise, the band 20 should be about 1" to 2½" less. This is conventional. It merely means that the diameter of the annular top of garment 27 is somewhat less than that of band 20, so that a neat fit of the band results.

As shown in FIG. 3, and as is conventional, the band 20 will be sewn directly to the top edge of the garment 27 in a straight fashion. However, when the garment is worn, the band 20 will adapt itself to the wearer's body curvature, indeed substantially adopting the curvature of band 20, which is shown in FIG. 2. This is the normal action of any such band, such as the prior type bands I described in my statement of the background of the invention, the difference being that my invention accomplishes this with a one-piece length of fabric as described herein. As is normal, the band should be stretched so as to fit the garment top evenly when sewn thereto.

Figure 4:
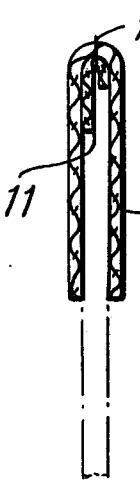
FIG. 4 is a cross-sectional view, as taken along the line 4—4 of FIG. 3.

FIG. 4 shows a typical disposition of the embraced tape 11, as sewn by stitching 14. The difference in length in the folded sides of tape 11 is of no significance. Indeed, the tape 11 need hardly be folded at all, since it can be sewn at one longitudinal edge along the inner face of fabric 10. Stitching 14, since it may be visible, may be of the same color as that of fabric 10, or it may be of a contrasting color. In fact, fabric 10 may be of a width whereby the folding thereof can conceal stitching 14 when desired. Also, tape 11 need not be at all precisely at the center of fabric 10, but rather substantially so, such as minutely away from such center of the fabric 10.

As hereinabove stated, the invention can be used in various environments of a garment, whether as a waistband, an armhole band, a neckband, or the like. Often, when the band is a waistband, a heavier fabric 10 is used since the stress put upon it is greater. In addition, although this is not necessary, a flat, thermoplastic, fusible inner lining can be pressed against the inner face of fabric 10, before tape 11 is applied. The lining simply reinforces the sturdiness of fabric 10, a characteristic not necessary in many other uses, such as armholes. When using such a lining, it will be bias cut to match that of fabric 10 so as to be essentially a part thereof.

I have shown a preferred embodiment of my invention but it is obvious that numerous changes may be made therein without departing from its spirit.

The band of this invention will not require skilled labor. It will considerably shorten labor time as opposed to the prior system of using different pieces sewn lengthwise to produce the desired contour. Further, the contour of my band will be more uniform and substantially automatic in reaching this desired result.

I claim:

1. An elongated fabric band having integral outer sides which are mutually opposed and doubled over each other centrally along the length of the band, the length of the band being substantially annular when the ends thereof are connected, said band outer sides being of a piece of fabric which is doubled over at its center to form a double thickness and a folded elongated edge, a flat tape shorter in length than said piece of fabric adhered substantially at the center of said piece of fabric from end to end of said piece of fabric, thereby forming a continuous series of puckers in said piece of fabric said piece of fabric being cut on the bias, and said tape being non-bias cut, said band being curved or arcuate along its length, said piece of fabric, were the band to be straightened, including said continuous series of puckers while said tape remains flat, whereby said band, when curved from its straightened state has said puckers removed while said tape still remains flat.

2. An elongated fabric band according to claim 1, and wherein said band has separated adjacent free longitudinal edges opposite to said folded elongated edge, said separated free edges being adapted to be sewn to the upper edges of trousers so that said band becomes a waistband for said trousers.

3. An elongated fabric band according to claim 2 and wherein said band is adapted to be sewn to said upper edges of said trousers when said band is in said straightened state and when the trouser upper edges are larger circumferentially than said band when in said annular form.

4. An elongated fabric band according to claim 3 and including interconnecting means at the respective ends of said band for retaining it in a substantially annular condition.

5. An elongated fabric band according to claim 4, and wherein said tape is woven and stitched at its elongated center line to the elongated center line of the inner face of said piece of fabric, the width of said tape being approximately one-eighth of the width of said piece of fabric before said fabric is doubled over.

6. A process for producing a curved or arcuate fabric band which comprises, sewing a flat, straight, non-bias cut, non-stretchable elongated tape along the full length of an elongated piece of fabric, which fabric is bias-cut and of a full straight length which is greater than the length of said tape so that puckers form in said piece of fabric, folding said piece of fabric longitudinally centrally upon itself and thereby enveloping said tape, and thereafter curving said band in the direction of the fold to eliminate said puckers.

7. A process according to claim 6, and wherein said tape is woven and is sewn from end to end, to the opposite ends of said longer piece of fabric, and thereafter pressing said band after it is curved, whereby the finished band is substantially flat and unwrinkled.

8. A process according to claim 7, and wherein said band is stitched at its fold to connect folded portions thereof and said tape, at said fold.

* * * * *